US005456303A

United States Patent [19]

Horinouchi

[11] Patent Number: 5,456,303

[45] Date of Patent: Oct. 10, 1995

[54] OPEN-AND-CLOSE SCREEN DOOR

[75] Inventor: Mitsuro Horinouchi, Tokyo, Japan

[73] Assignee: Seiki Hanbai Co., Ltd., Tokyo, Japan

[21] Appl. No.: 200,275

[22] Filed: Feb. 23, 1994

[51] Int. Cl.[6] ..... F06B 9/06

[52] U.S. Cl. ..... 160/84.04; 160/84.06

[58] Field of Search ..... 160/84.1 E, 84.1 R, 160/84.1 C, 107, 265, 274

[56] References Cited

U.S. PATENT DOCUMENTS

| | | | |
|---|---|---|---|
| 1,959,137 | 5/1934 | Miller | 160/84.1 E |
| 4,694,877 | 9/1987 | Dunbar | 160/84.1 E |
| 5,195,569 | 3/1993 | Peterson et al. | 160/84.1 |

FOREIGN PATENT DOCUMENTS 6-1696 1/1994 Japan .

*Primary Examiner*—Blair M. Johnson

*Attorney, Agent, or Firm*—Oblon, Spivak, McClelland, Maier & Neustadt

[57] ABSTRACT

An openable and closeable screen door has a wire-netting screen that can be freely expanded and contracted and a mechanism to ensure that a handle bar moves smoothly without breaking the parallelism between its top and bottom end. The handle bar is attached to the leading end of the screen that can be pulled out from a screen case that constitutes one side of a doorframe. The handle bar is movable along upper and lower guide frames. The tail ends of a pair of strings are attached to the bottom end of the handle bar. The strings are extended and wrapped over deflectors disposed at the lower ends of the screen case handle bar stopper, deflectors disposed at their upper ends, and again over deflectors. The leading ends of the strings are fastened to the top end of the handle bar. All segments of the two strings thus extended run in the same direction, thereby markedly decreasing friction therebetween.

3 Claims, 2 Drawing Sheets

OPEN-AND-CLOSE SCREEN DOOR

FIELD OF THE INVENTION

This invention relates to open-close screen doors comprising a floldable or rollable wire-netting screen.

DESCRIPTION OF THE PRIOR ART

An accordion-type openable and closeable screen door comprises a pleated foldable wire-netting screen, with one end thereof fastened to a screen case that constitutes one side of a doorframe and the other end thereof carrying a handle bar attached thereto and transversely guided by an upper and lower guide frame. Because the screen does not restrain the posture of the handle bar, it is necessary to hold the handle bar in fixed posture to ensure a smooth motion thereof parallel to the upper and lower guide frames. In a roll-type screen door whose wire-netting screen is rolled up and unrolled, the unrolled screen to some extent restrains the posture of the handle bar at the head end thereof. As this restraint is not an absolute one, however, the handle bar can still change its posture freely to break parallelism.

Therefore, some mechanism to ensure a stable parallel motion of the handle bar should preferably be added to the open-and-close screen doors of the types described above. One example of screen doors equipped with such mechanism is proposed in Japanese Provisional Utility Model Publication No. 1696 of 1994. While assuring a stable parallel motion of the handle bar, however, this screen door presents the following problem where there is a need to reduce the thickness of the screen door to a minimum because of space limitations.

This screen door comprises, as shown in FIG. 1, a wire-netting screen 101 that is foldable like an accordion. One end of the wire-netting screen is fastened to a screen case 104 that constitutes one side of a doorframe 101, whereas the other end carries a handle bar 108 to the top and bottom ends of which are fastened one end of strings 111 and 112. The strings 111 and 112 are passed first over pulleys 113 and 114 at the top and bottom ends of a handle bar stopper 107 disposed opposite to the screen case 104, next, after being turned around, over pulleys 115 and 116 at the top and bottom ends of the screen case 104, thence over pulleys 117 and 118 respectively opposite to the pulleys 115 and 116, with the leading ends thereof fastened to the handle bar 108.

As described above, this screen door has the pulleys 115 and 118 that carry the strings 111 and 112 at the top end of the screen case 104. When the handle bar 108 moves in either direction, the strings 111 and travelling thereover in opposite directions rotate the pulleys 115 and 118 in opposite directions. Therefore, the pulleys 115 and 118 cannot be replaced with a single pulley even if the replacement is desired for space savings. The same goes for the pulleys 116 and 117 at the bottom end of the screen case 104. Even if the two each pulleys at the top and bottom ends were placed some distance apart from each other, the strings 111 and 112 that intersect at the midpoint of the screen case 104 could come in contact with each other. The strings 111 and 112 running in opposite directions would cause serious damages to each other due to friction.

As a consequence, it becomes necessary to keep two pulleys each at the top and bottom ends of the screen case 104 and the strings wrapped thereover away from each other by disposing the two each pulleys away from each other with respect to the axis of rotation thereof. This necessity makes it difficult to decrease the thickness of the entire screen door.

SUMMARY OF THE INVENTION

An object of this invention is to provide a mechanism to ensure an accurate parallel motion to the handle bar of an accordion-type or roll-type openable and closeable wire-netting screen door that comprises strings that are adapted to run in the same direction where the direction of their travel is changed and where they run parallel to each other. The strings thus disposed make it possible to reduce the friction therebetween and to decrease the number of and space requirement for the pulleys at the top and bottom ends of the screen case by employing one pulley at each of the top and bottom ends instead of the two in the conventional mechanism described before.

Another object of this invention is to provide a thinner open-and-close wire-netting screen door by fitting the mechanism described above that permits decreasing the number of and space requirement for the pulleys at the top and bottom ends of the screen case.

In order to achive the above objects, an openable and closeable wire-netting screen door of this invention comprises a foldable or rollable wire-netting screen, with one end thereof fastened to a screen case that constitutes one side of a doorframe and the other end thereof carrying a handle bar that is attached thereto and is transversely guided by an upper and lower guide frame. The tail ends of a pair of strings are fastened to the top or bottom end of the handle bar, one string each on each side thereof. The strings are horizontally extended in opposite directions along a first guide frame at the top or bottom of a doorframe, wrapped over a first pair of deflectors provided at one end of the screen case and a handle bar stopper opposite thereto, extended to the opposite ends of the screen case and handle bar stopper, wrapped over a second pair of deflectors provided thereat, horizontally extended therefrom along a second guide frame, and turned around over the second pair of deflectors, with the head ends of the strings fastened to the other end of the handle bar.

Another openable and closeable wire-netting screen door of this invention comprising a foldable or rollable wire-netting screen, with one end thereof fastened to a screen case that constitutes one side of a doorframe and the other end thereof carrying a handle bar that is attached thereto and transversely guided by an upper and lower guide frame, has a pleated accordion-type wire-netting screen. The tail ends of a pair of strings fastened to the upper or lower part of the handle bar, one string each on each side thereof. The strings are horizontally extended in opposite directions, wrapped over a first pair of deflectors provided on the screen case and a handle bar stopper opposite thereto, extended to the opposite ends of the screen case and handle bar stopper, wrapped over a second pair of deflectors provided thereat, horizontally extended therefrom, and turned around over the second pair of deflectors, with the head ends of the strings fastened to the handle bar. Of the deflectors described above, those on the handle bar stopper are disposed at the top and bottom ends thereof to extend the strings wrapped therearound horizontally along the guides at the top and bottom of the doorframe. The one on the screen case to wrap around the string fastened to the handle bar is disposed at a point either in the upper or lower half of the screen case. The strip between the handle bar and the deflector in the upper or lower half on the screen case is threaded through the upper of lower half of the screen case and is threaded through the wire-netting screen.

In the openable and closeable wire-netting screen doors of the types just described, the strings restrain the posture of the handle bar. When, for example, one end of the handle bar is gripped to open or close the screen door, the force applied thereat is transmitted through the strings to the opposite side of the handle bar as if both ends thereof were gripped simultaneously. This causes the handle bar to move correctly, with both ends thereof moving parallel to each other, thus assuring a stable openable and closeable motion of the screen door.

When the handle bar moves, the two strings move in the same direction after changing the direction of their travel at the upper ends of the screen container and the opposite handle bar stopper. Therefore, it is unnecessary to provide an individual pulley or a deflector for each string. One deflector can serve two strings. Even if two strings come in contact before or after the deflector, little friction-induced damage occurs because the two strings are moving in the same direction.

This eliminates the need for separating the paths of the two strings and, as a consequence, permits reducing the thickness of the entire screen door.

Because a pleated accordion-type wire-netting screen is highly bendable, it is necessary to prevent the slackening thereof by its own weight or under the action of wind. The string fastened to the upper or lower part of the handle bar, wrapped over the deflector on the screen case and threaded slidably along the screen holds the collapsible screen in a stable posture by preventing the slackening thereof.

DESCRIPTION OF THE PREFERRED EMBODIMENTS

Figure 1:
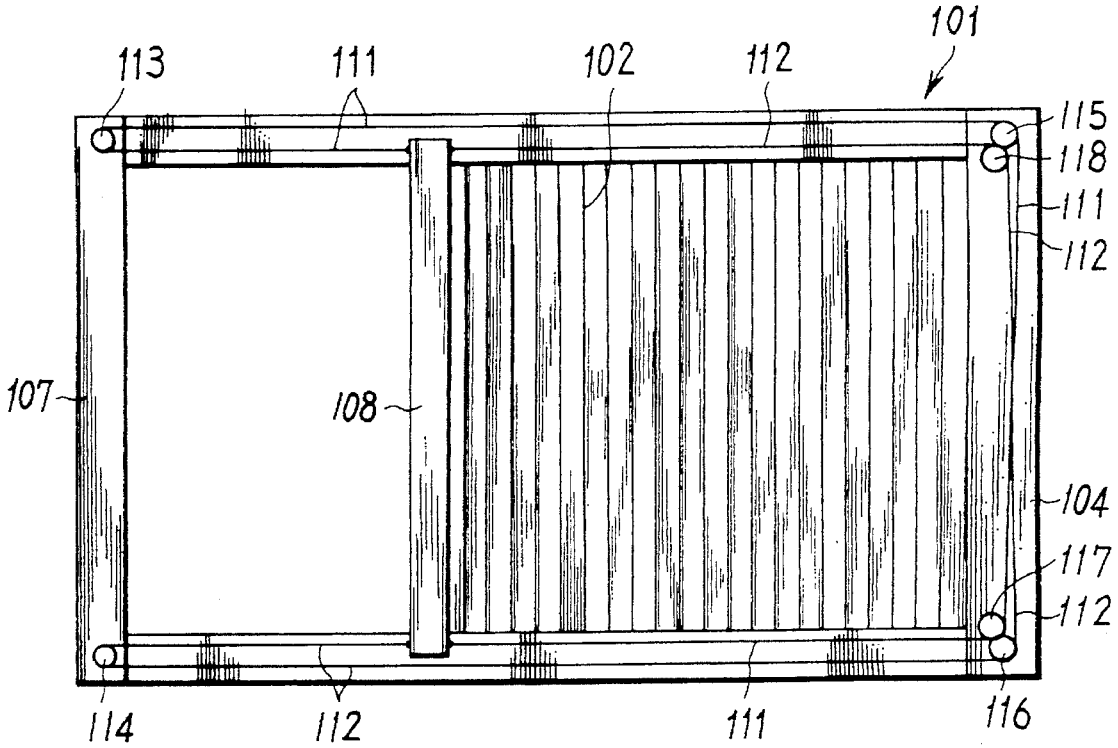
FIG. 1 schematically illustrates the construction of a mechanism to ensure parallel motion of the handle bar of a conventinal open-and-close screen door.
Figure 2:
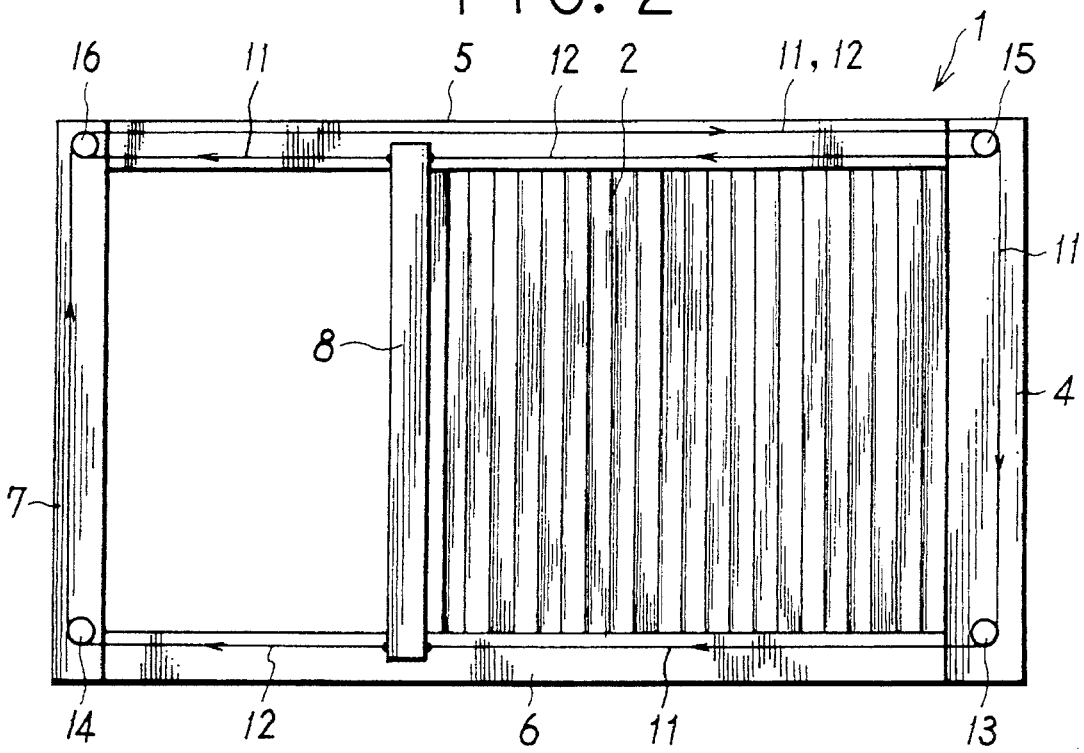
FIG. 2 schematically shows the construction of a mechanism to ensure a parallel motion of the handle bar used in a first open-and-close screen door according to this invention.
Figure 3:
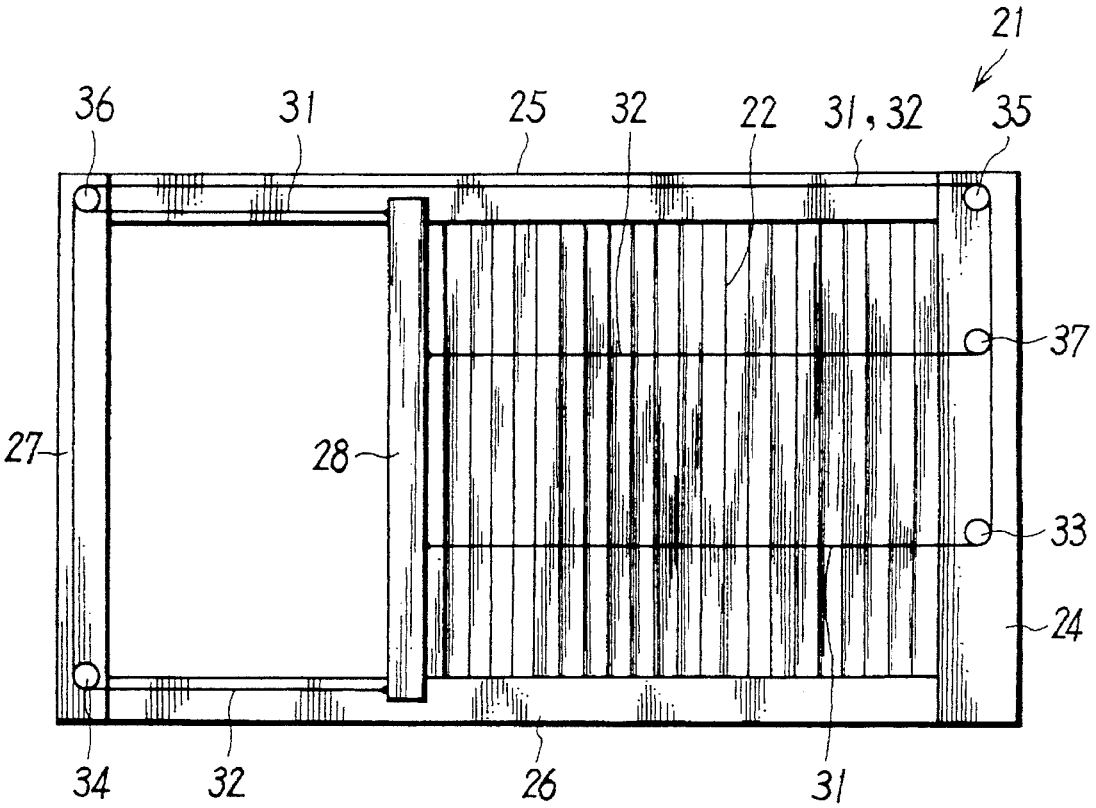
FIG. 3 is a similar schematic illustration of the second open-and-close screen door according to this invention.

FIGS. 2 and 3 schematically illustrate the construction of a first and a second openable and closeable screen doors according to this invention.

In a first embodiment shown in FIG. 2, an open-and-close wire-netting screen 2 is fitted to a rectangular doorframe 1. The screen 2 may be of any type so long as the screen can be pushed into and pulled out of a screen case provided on one side of the frame, such as, for example, the accordion type consisting of a pleated screen that can be expanded and contracted and the roll type consisting of a flat screen that can be rolled up and unrolled.

The doorframe 1 is made up of a screen case 4 that is disposed on one side thereof to hold the screen 2 therein, top and bottom guide frames 5 and 6 connected to the top and bottom ends of the screen case 4, and a handle bar stopper 7 connected to the other end of the guide frames 5 and 6 opposite to the screen case 4. A handle bar 8 attached to the leading end of the screen 2 for pulling out the screen from the case 4 is movable along the guide frames 5 and 6. The handle bar 8 can be moved by means of a deflector fitted to the upper or lower end thereof and rolled along a rail installed on the guide frame 5 or 6, or by sliding either end thereof along a guide rail fitted to the guide frame 5 or 6.

A mechanism that restrains the posture of the handle bar 8 to ensure that the handle bar 8 always moves smoothly parallel to the guide frames 5 and 6 comprises a pair of strings 11 and 12 whose tail ends are attached to the lower end of the handle bar 8. The strings 11 and 12 are extended along the lower guide frame 6 in opposite directions from the handle bar 8 to the screen case 4 and the handle bar stopper 7. After being wrapped over deflectors 13 and 14 at the bottom ends of the screen case 4 and handle bar stopper 7, the strings 11 and 12 are extended upward to deflectors 15 and 16 at the top ends. The strings 11 and 12 wrapped over the deflectors 15 and 16 are extended along the upper guide frame 5 to the opposite deflectors 16 and 15. The leading ends of the strings 11 and 12 turned around over the deflectors 16 and 15 are fastened to the upper end of the handle bar 8.

The screen case 4 for the roll-type screen 2 is shaped like a box with a partial opening through which the screen is rolled in and out. The screen case 4 for the pleated accordion-type screen 2 is shaped like a vertical groove to hold the screen therein (see FIG. 4). The base end of the screen 2 is fastened to the innermost end wall of the groove-shaped case 4. When the screen 2 is pushed therein, the handle bar 8 covers the open end of the groove-shaped case 4.

Each deflector may consist of either a pulley consisting essentially of a rotatable wheel or a fixed guide member of synthetic resin or other similar materials that offer little frictional resistance to the travel of the strings wrapped therearound. Each of the deflectors 15 and 16 disposed at the upper ends of the screen case 4 and handle bar stopper 7 carries two strings 11 and 12. The strings 11 and 12 may be wrapped over either one common rim or two separate rims in one deflector. Otherwise, two of each of the deflectors to carry the individual strings may be provided at each of the upper ends.

The deflectors 15 and 16 need not be attached to the screen case 4 and handle bar stopper 7 themselves. They may be attached to the upper and lower guide frames 5 and 6 fastened to the upper and lower ends of the screen case 4 and handle bar stopper 7.

In an openable and closeable screen door of the type just described, the strings 11 and 12 whose ends are fastened to the upper and lower ends of the handle bar 8 restrain the posture, not the position, thereof. When any part, such as a part near one end, of the handle bar 8 is gripped to push in or pull out the screen 2, therfore, the applied force is transmitted to the other end thereof through the strings 11 and 12 as if both ends of the handle bar 8 were gripped simultaneously. This ensures the stable correct motion of the handle bar 8 parallel to the upper and lower guides.

For example, suppose that force is applied to the handle bar 8 to move it to the left in FIG. 2. Then, the strings 11 and 12 moving in the direction of the arrows allow the handle bar 8 to move the left while being held in the correct posture.

When the handle bar 8 moves, the strings 11 and 12 run in the same direction after changing the direction of their travel at the upper ends of the screen case 4 and the opposite handle bar stopper 7. Therefore, the two strings 11 and 12 at each upper end may be wrapped over either two individual deflectors or one and the same deflector. Even if the strings 11 and 12 come into contact with each other at, before or after the deflector or deflectors, little friction-induced damage occurs because the strings are moving in the same direction. As can also be appreciated from a review of FIG. 2, when opening the screen, each of the deflectors rotate in the same direction (i.e., counterclockwise). When closing the screen, each of the deflectors rotate in the same opposite direction (i.e., clockwise).

This eliminates the need for separating the paths of the two strings and, as a consequence, permits reducing the thickness of the entire screen door.

The segments of the strings 11 and 12 upstream and downstream of the deflectors 15 and 16 at the upper ends of the screen case 4 and handle bar stopper 7 run in opposite directions. However, the strings do not intersect each other in this area. Besides, a large enough clearance can be left between the two strings. Therefore, there will be no contact between the two strings that might cause friction or abrasive wear.

In the first embodiment just described, the guide frame 6 should preferably be kept as low as possible in the doorway formed between the handle bar 8 and stopper 7. This is because the two strings are turned around and doubled, one segment thereof running above the other, along the upper guide frame 5. If there is no need to limit the height of the lower guide frame 6, the strings and deflectors disposed atop can, of course, be moved on to the lower guide frame.

Figure 4:
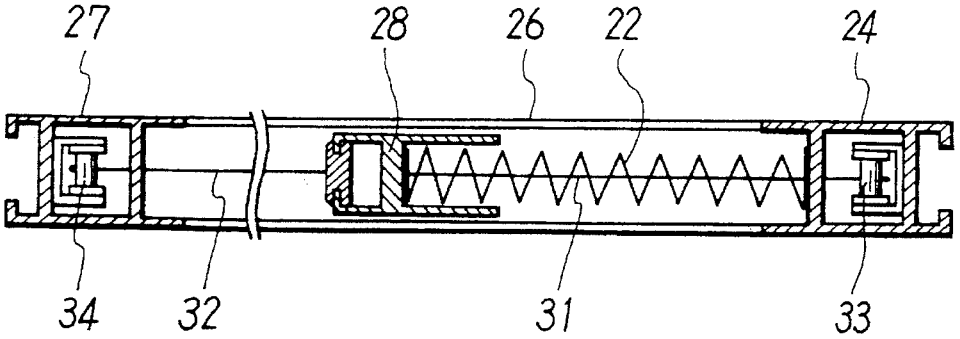
FIG. 4 is a horizontal cross section of the same embodiment of this invention.

FIGS. 3 and 4 show a second embodiment of this invention comprising a pleated accordion-type wire-netting screen 22 that can be freely expanded and contracted. While one end of the screen 22 is fastened to a screen case 24 that constitutes one side of a frame 21, the other end carries a handle bar 28 that is attached thereto and adapted to move along guide frames 25 and 26 at the top and bottom.

This screen door ensures the parallel motion of the handle bar by employing a mechanism similar to the one used in the first embodiment described before. The tail ends of two strings 31 and 32 are attached to the lower side of the handle bar 28. The strings 31 and 32 are horizontally extended in opposite directions from the handle bar 28 to deflectors 33 and 34 on the screen case 24 and the opposite handle bar stopper 27. The strings 31 and 32 turned therearound and extended upward are then wrapped over deflectors 35 and 36, from which the strings are extenteded horizontally along the guide frame 25 to the deflectors 36 and 35 at the upper ends of the handle bar stopper 27 and the opposite screen case 24. The leading ends of the strings 31 and 32 turned therearound are fastened to the handle bar 28.

Unlike their counterparts in the first embodiment described before, however, the tail ends of the strings 31 and 32, which are both extended from the lower part of the handle bar 28 and then respectively around the lower and upper deflectors 33 and 37 on the screen case 24, are connected to the midpoints of the lower and upper half portions of the handle bar 28. Besides, the strings 31 and 32 are slidably threaded through the wire-netting screen 22.

Because the tail ends of the strings 31 and 32 are fastened to the midpoints of the lower and upper half portions of the handle bar 28, the deflector 33, which corresponds to the deflector 13 at the lower end of the screen case of the first embodiment, is located at a point in the path of the string 31 in the lower half portion of the screen case 24. The deflector 37 is located on the screen case 24 to turn the string 32 to the handle bar 28 at the midpoint thereof. Namely, the deflectors provided on the screen case 24 to carry the strings whose ends are fastened to the handled bar 28 are located at the midpoints of the upper and lower half portions of the case 24. On the other hand, the deflectors provided on the handle bar stopper 27 are located at the upper and lower ends thereof, with the strings turned therearound horizontally extending from the handle bar stopper 27 and along the upper and lower guide frames 25 and 26.

The mechanism just described performs substantially the same function in the second embodiment having the pleated accordion-type wire-netting screen 22 as in the first embodiment described before. However, it is necessary to repress the tendency of the accordion-type screen 22 to become slackened by its own weight or under the action of wind. The posture of the screen 22 can be stabilized by preventing the slackening thereof by threading that segment of the strings 31 and 32 which extends from the deflectors on the screen case 24 and upper and lower parts of the handle bar 28. When opening or closing the screen, all deflectors respectively move in a counterclockwise or clockwise direction, respectively, as can be appreciated from a review of FIG. 3.

The location of the strings and deflectors in the second embodiment can also be reversed as in the first embodiment.

The number of strings may also be increased. An increased number of strings are similarly connected to the upper or lower parts, or both, of the handle bar 28, extended to the screen case, wrapped over a corresponding number of deflectors disposed at suitable intervals, and then threaded through the wire-netting screen 28, with all strings extended parallel to each other, back to the handle bar 28.

What is claimed is:

1. An openable and closable screen door, comprising:

a screen case forming one side of a door frame, said frame further having top and bottom guide frames;

an extendable wire-netting screen having one end fastened to said screen case;

a handle bar mounted on the opposite end of the screen opposite said screen case wherein said handle bar extends between and is movable along the top and bottom guide frames and serves as a grip when opening and closing the screen;

a pair of strings, with the tail ends thereof fastened to respective opposite sides of said handle bar at respective top and bottom ends thereof, said strings extending horizontally in opposite directions from the handle bar along the respective upper or lower guide frames a plurality of deflectors over which the strings are wrapped, a first and second deflector of said deflectors being respectively provided at a top and bottom end of the screen case; and a handle bar stopper on said door frame disposed opposite the screen case, wherein a third and fourth deflector of said plurality of deflectors are respectively disposed at bottom and top ends of said handle bar stopper such that upon opening and closing of said screen, said deflectors are all rotatable together in the same of one of a first and second direction of rotation;

wherein the strings extend horizontally along the guide frame and are turned around over the deflectors on the handle bar stopper and screen case; and the leading ends of the strings are fastened to opposite sides of the end of the handle bar opposite to the respective end to which the tail ends thereof are attached.

2. An openable and closable screen door, comprising:

a screen case forming one side of a door frame and said frame further having top and bottom frames;

an extendable wire-netting screen having one end fastened to said screen case;

a handle bar mounted on the end of the screen opposite, said handle bar extending between and being movable along the top and bottom guide frames and serving as a grip for opening and closing the screen;

the extendable wire-netting screen comprising a pleated accordion-type wire-netting screen;

a pair of strings having tail ends respectively fastened to opposite sides of said handle bar at respective top and bottom ends thereof, said strings extending horizontally in opposite directions from the handle bar;

a plurality of deflectors mounted on the screen case and over which the strings are wrapped;

a handle bar stopper on said door frame disposed opposite the screen case, wherein the respective strings extend in one of a downward and upward direction on the screen case and are wrapped over deflectors disposed at a respective bottom and top end of the handle bar stopper and wherein the strings further extended horizontally from the deflectors of the handle bar stopper and are turned around over opposite deflectors on the screen case;

leading ends of the strings are fastened to the sides of the handle bar opposite said tail ends;

the deflectors on the handle bar stopper permit the strings wrapped therearound to extend horizontally therefrom along the upper and lower guide frames; and the deflectors on the screen case are substantially disposed at midpoints of an upper and lower half portion of the screen case, with the strings extending therefrom to the handle bar and being threaded through the wire-netting screen.

3. An openable and closable screen door as claimed in claim 2 wherein upon opening and closing of said screen, all of the deflectors are rotatable together in the same of one of a first and second direction.

* * * * *